US007048332B1

(12) United States Patent
Dilling

(10) Patent No.: US 7,048,332 B1
(45) Date of Patent: May 23, 2006

(54) MODULAR TRIANGULAR DESK

(76) Inventor: Gertraude M. Dilling, #10 51st Ave., Isle of Palms, SC (US) 29451

( * ) Notice: Subject to any disclaimer, the term of this patent is extended or adjusted under 35 U.S.C. 154(b) by 0 days.

(21) Appl. No.: 10/877,624

(22) Filed: Jun. 25, 2004

(51) Int. Cl.
*A47B 83/02* (2006.01)

(52) U.S. Cl. ..... 297/172; 297/232; 297/249

(58) Field of Classification Search ..... 297/170, 297/172, 174 R, 232, 249
See application file for complete search history.

(56) References Cited

U.S. PATENT DOCUMENTS

| | | | | |
|---|---|---|---|---|
| 2,162,560 | A * | 6/1939 | Larsen | 297/171 |
| D163,170 | S * | 5/1951 | Eibetz | D6/340 |
| D169,170 | S * | 3/1953 | Musacco | D11/58 |
| 2,732,007 | A * | 1/1956 | MacWhirter | 297/172 |
| 3,020,086 | A * | 2/1962 | Barber | 297/170 |
| 4,345,803 | A | 8/1982 | Heck | |
| 4,706,919 | A * | 11/1987 | Soberalski et al. | 248/281.11 |
| 4,798,411 | A | 1/1989 | Lin | |
| 4,925,240 | A | 5/1990 | Peters | |
| 5,056,864 | A | 10/1991 | Cooper | |
| 5,169,210 | A | 12/1992 | Fricano | |
| D346,071 | S | 4/1994 | Sharar | |
| 5,452,950 | A * | 9/1995 | Crenshaw et al. | 297/174 R |
| 5,542,746 | A | 8/1996 | Bujaryn | |
| 5,697,668 | A | 12/1997 | Chao | |
| 6,039,392 | A | 3/2000 | Dencker | |
| 6,170,926 | B1 | 1/2001 | Roberts et al. | |

* cited by examiner

*Primary Examiner*—Peter R. Brown
(74) *Attorney, Agent, or Firm*—Harleston Law Firm, LLC; Kathleen M. Harleston

(57) ABSTRACT

A stackable, modular triangular desk for holding a computer while providing an easily accessible work area includes:

(a) a generally triangular-shaped, substantially planar desk top portion;

(b) a frame attached to the desk top portion supporting the desk top portion in an elevated position; and (c) a chair portion supported by the same frame and spaced apart from a front edge of the desk top portion;

wherein the frame comprises only two frame components that support the desk on a floor surface, one of the frame components being connected to the chair portion, and the other of the frame components being connected to the desk top portion.

22 Claims, 12 Drawing Sheets

MODULAR TRIANGULAR DESK

CROSS REFERENCE TO RELATED DOCUMENT

Priority is claimed under U.S. patent application Ser. No. 10/877,624, which was filed on 25 Jun., 2004 by Applicant.

BACKGROUND OF THE INVENTION

1. Technical Field

The present invention relates to a triangular desk, more particularly, a compact modular triangular desk for supporting a notebook computer or a computer monitor and keyboard while providing an easily accessible work area.

2. Background Information

Increasingly computers are becoming permanent fixtures in schools from elementary through college level. Most private and public schools have computer labs separate from traditional classrooms. When students have to use the school's computers, they travel from their classroom to the computer lab. Then, when they are again ready for instruction in front of a blackboard, they all travel back to their classroom. This arrangement is inconvenient in that students and teachers loose precious, instructional time moving about the building, or between school buildings. The student's records are often at his or her desk. Also, the number of students often greatly exceeds the number of computers.

Uses for computers in the classroom extend far beyond word processing and Internet research. There are many computerized interactive teaching aids for subjects ranging from Algebra to Spanish. These computerized teaching aids are usually most effective when combined with concurrent or intermittent teacher instruction. As the student becomes more and more familiar with his or her own computer, he or she begins to identify with it.

As another example, when teachers instruct students on the use of a software program, it is helpful for each student to follow along on his or her own computer. As computers permeate more and more aspects of our lives, students need more than occasional access to computers in order to become proficient users and keep pace with innovation, new interfaces, new and updated software, etc. Today, ideally, every student should have constant access to a computer. In the future, this may be a necessity, not just a luxury.

Conventional rectangular student desks are not designed to accommodate computers. If a computer monitor and keyboard are placed on such a desk, there is no appreciable work space left. Thus, there is a need for a student desk, which holds a computer monitor, keyboard, and other computer-related items, while still furnishing ample elbow room and work space.

BRIEF SUMMARY OF THE INVENTION

The present invention is a modular triangular desk with an attached chair. This modular triangular desk is primarily intended to support a notebook or desktop computer in a classroom setting, yet still provide ample work space. The desk of the present invention includes the chair and a triangular shaped desk top, as well as a frame that elevates the desk top and chair to an appropriate, predetermined height and maintains the chair an appropriate distance from the desk top. In its preferred embodiment, the desk top possesses the shape of an equilateral triangle.

This modular triangular desk has several advantages over currently available student desks. The generally triangular-shaped desk top of the present invention accommodates a computer, while providing a wider, vacant writing surface at the front of the desk where the student requires it. The desk of the present invention also has an arm, or rest, for holding a keyboard, and, if desired, a mouse pad area in an ergonomically practical position for use during the day. When the student no longer needs to utilize the computer, the keyboard arm/rest is rotatable 180 degrees. The keyboard arm stores out of the way under the desk top. When the keyboard arm or rest is inverted, gravity causes most crumbs and dirt particles, such as dust, that have accumulated between the keys to dislodge. Rotation of the keyboard arm/rest also permits the student to more easily access the vacant surface of the desk top.

The attached chair gives the student freedom to move his or her chair without inflicting damage to the classroom floor. Damage to school floors from the feet of the four legs of a conventional student chair has caused some schools to place used tennis balls over the feet. This is not a good solution, since it is an invitation to some unsupervised students to pull the tennis balls off and toss or roll them around the room. Even if they are not pulled off, the tennis balls often come loose and have to be replaced over the feet.

Next, the generally triangular shape of the present triangular desk is more space efficient, versatile, and practical than conventional, rectangularly-shaped student desks. The instant modular triangular desks can quickly and easily be grouped into a number of alternate space-efficient arrangements to improve classroom layout. For example, they can be placed side by side to form a tight cluster of six desks, or they can be placed into various interesting circular, semicircular, ovular, triangular, or linear arrangements. The arrangements of these triangular desks also retain their configuration. The present desks can be temporarily coupled to one another. Most currently available student desks do not include a means of attachment to one another, and arrangements of these desks are readily distorted, causing teachers, students, and custodians to waste time straightening up the desks. Also, some students enjoy scooting their desks across the classroom in discrete increments each time the teacher looks away. Thus, individual, conventional, movable student desks are often a source of distraction and confusion.

The present triangular desks are stackable, which facilitates moving or storing them. Since the instant modular triangular desks save space, classrooms may be smaller, and more students can be placed in existing classrooms. In its preferred embodiment, the modular triangular desk is made almost entirely from plastic and/or aluminum, and is therefore sturdy and easy to manufacture.

Lastly, removable attachments make the modular triangular desk customizable and suitable for applications outside of the classroom. For example, these desks may be utilized in home or office settings. Many modern offices are large, open spaces with movable room dividers and office furniture that is designed to be reconfigurable. This is facilitated by the present modular triangular desks.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
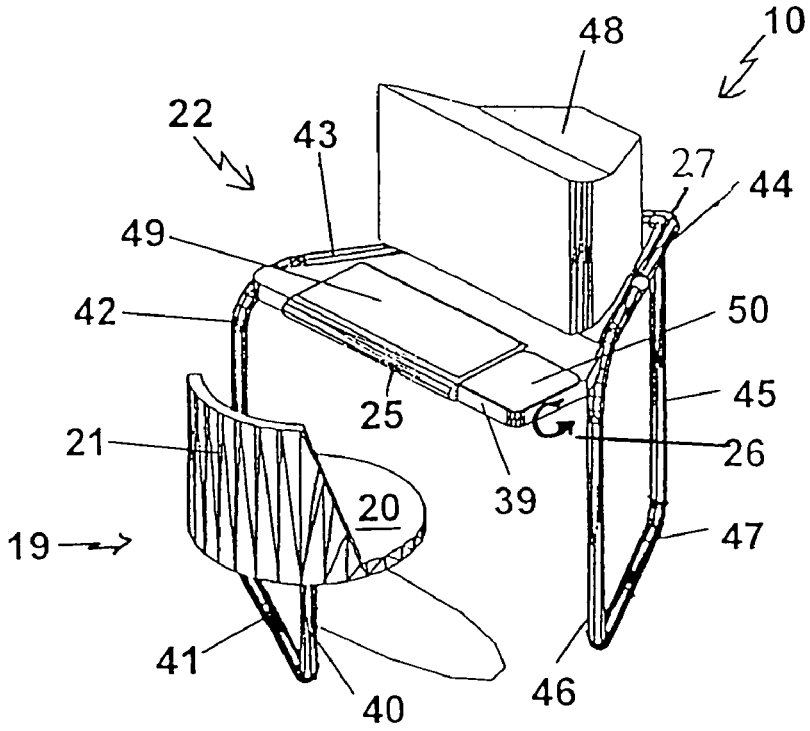
FIG. 1 shows a perspective view of a modular, triangular-shaped desk according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 2A:
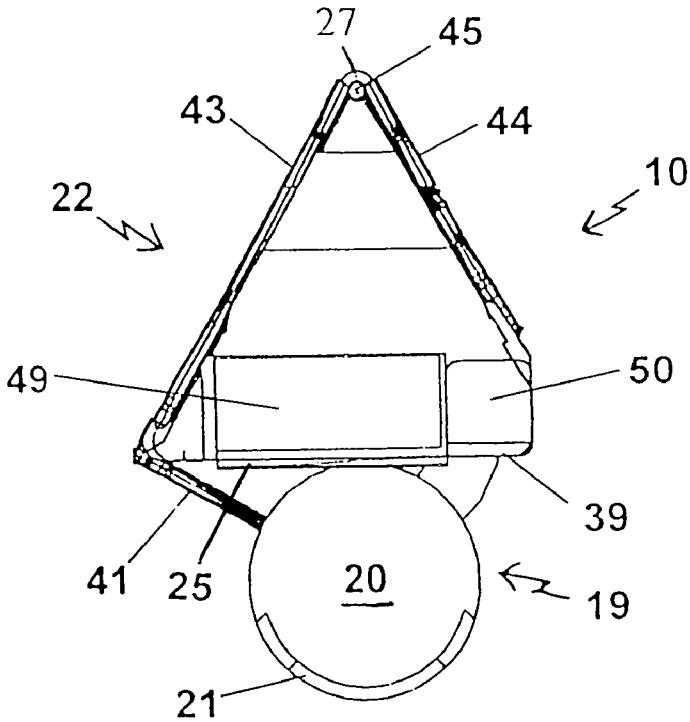
FIG. 2A is a top plan view of a modular, triangular-shaped desk according to FIG. 1.

Turning first to FIGS. 1 and 2A, a modular, triangular-shaped desk according to the present invention, generally referred to herein as 10, is comprised of an attached chair portion 19, a planar, generally triangular-shaped desk top portion 22, and a frame 18 supporting the chair portion 19 and the desk top portion 22. The desk top portion 22 is oriented in a substantially horizontal plane. In the preferred embodiment shown in FIGS. 1 and 2A, the desk top portion 22 accommodates a computer monitor 48, a keyboard 49, and a mouse pad 50.

Figure 2B:
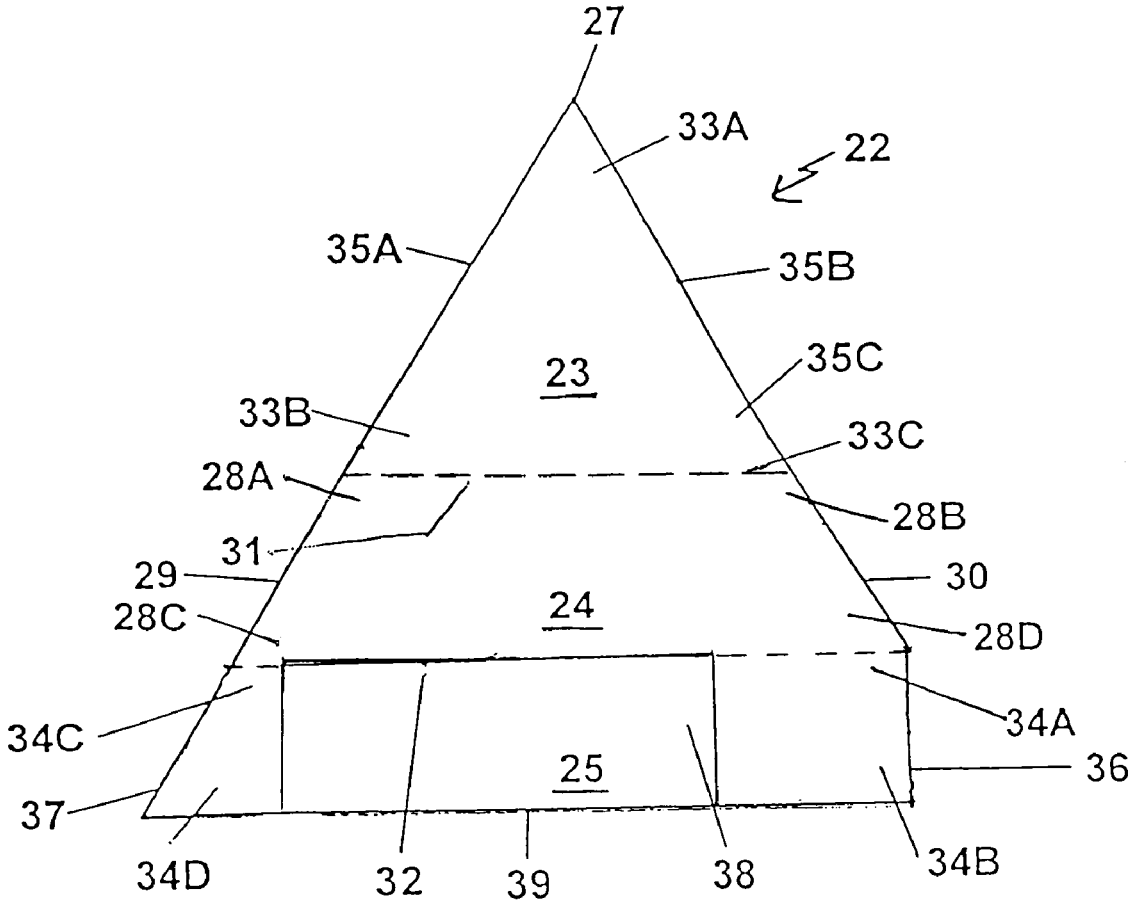
FIG. 2B is a schematic top plan view of a desk top of a modular, triangular-shaped desk according to FIG. 2A.

Referring to FIG. 2B, the desk top 22 comprises a monitor portion 23, a work portion 24, and a keyboard arm 25. The monitor portion 23, which accommodates the computer monitor, is in the shape of a triangle having three, acute interior angles 33A–C and three edges 35A–C. Edges 35A and 35B meet to form angle 33A, which is the apex 27 of the triangle and is located at the rearmost end of the desk 10. Edge 35C forms the base of the triangle. Edges 35A and 35C meet to form angle 33B and edges 35B and 35C meet to form angle 33C. The monitor portion is at the rear of the desk top.

The work portion 24, which is in front of the monitor portion 23, is in the shape of a trapezoid having two, obtuse, interior angles 28A–B and two, acute, interior angles 28C–D, two, opposed non-parallel edges 29, 30, and two, opposed parallel edges 31, 32. The obtuse angles 28A–B lie between the first parallel edge 31 and the first and second non-parallel edges 29, 30, respectively, while the acute angles 28C–D lie between the second parallel edge 32 and the first and second non-parallel edges 29, 30, respectively.

As shown in FIG. 2B, the keyboard arm 25, which accommodates the computer's keyboard, is in the shape of a trapezoid having first and second right angles 34A–B, an obtuse angle 34C, and an acute angle 34D, two, opposed non-parallel edges 36, 37, and two, opposed parallel edges 38, 39. The right angles 34A–B lie between the first non-parallel edge 36 and the first and second parallel edges 38, 39, respectively. The obtuse angle 34C and the acute angle 34D lie between the second non-parallel edge 37 and the first and second parallel edges 38, 39, respectively. The keyboard arm 25 is at the front of the desk 10, where it is easily accessed by a student seated in the seating surface 20.

The edge 35C of the monitor portion 23 is generally parallel to and abuts the first parallel edge 31 of the work portion 24. The second parallel edge 32 of the work portion 24 is generally parallel to and abuts the first parallel edge 38 of the keyboard arm 25. Edges 35A, 29, and 37 are flush, forming one edge of the desk top portion 22, and edges 35B and 30 are flush, forming another edge of the desk top portion 22, such that the entire desk top is generally triangular in shape. Angles 33B–C, 28C–D, and 34D are equal in size, while angles 28A–B and 34C are equal in size. Most preferably, the monitor portion 23 is in the shape of an equilateral triangle, with angles 33A–C, 28C–D, and 34D being 60 degrees, angles 34A–B being 90 degrees, and angles 28A–B and 34C being 120 degrees.

The monitor portion 23 and the work portion 24 are preferably contiguous and made from a single piece of material. The monitor portion 23 is large enough to accommodate a computer monitor 48 so that the monitor 48 does not impinge on the work portion 24. The work portion has space for a student to set books and papers and conduct non-computer related work, such as reading and writing. The keyboard arm 25 accommodates a computer keyboard 49. The computer tower, if there is one, can be placed beneath the desk top portion, optionally on a shelf beneath the desk top.

The keyboard arm 25 is preferably rotatable in order to allow the student better access to the work portion 24. At least one hinge (not shown) connects adjacent edges 32 and 38 of the work portion 24 and the keyboard arm 25 such that the keyboard arm 25 is rotatable 180 degrees about the work portion 24 in the direction of arrow 26. When the student needs access to the keyboard 49, he or she positions the keyboard arm 25 in the same horizontal plane as the work portion 24, as shown in FIG. 1, and a locking mechanism retains the keyboard arm 25 in this position. When the student does not need access to the keyboard 49, he/she inverts the keyboard arm 25, i.e., rotates it 180 degrees, and the locking mechanism secures the arm to an underside of the work portion 24.

The keyboard 49 is removably anchored to the keyboard arm 25 by hook and loop strips or any other suitable means. Thus, when the keyboard arm 25 is inverted, the keyboard 49 turns upside down with the keyboard arm. As a result, crumbs and other dirt particles, such as dust, fall out of the crevices of the keyboard 49 due to the force of gravity and can be easily swept up. In a preferred embodiment, inversion of the keyboard arm 25 shuts down the computer via a small switch triggered by rotation of the keyboard arm. A notebook computer does not require a switch; it can simply be removed from the docking station on the desk top portion. A student can remove the notebook 53 from the desk 16 and use it at home. In the classroom, the student can re-attach the notebook 53 to the docking station, which may include a fixed keyboard 49.

A mouse pad 50 may be removably anchored by hook and loop strips or the like to the keyboard arm 25 to the left or right of the keyboard 49, depending upon the student's dexterity. In order to use a mouse, the student or other user sets the mouse on the mouse pad 50 and drags it around the mouse pad 50. Before inverting the keyboard arm 25, the student removes the mouse from the mouse pad 50 and stores the mouse, so the mouse will not fall from the inverted keyboard arm 25 and sustain damage.

Suitable anchoring mechanisms, such as hook and loop strips, can be included on the triangular desk 10 for altering the configuration of the keyboard 49 and mouse pad 50 in the classroom to accommodate both left-handed and right-handed students. Alternatively, the triangular desks 10 may be fabricated in the manufacturing plant as left-handed desks and right-handed desks.

Referring back to FIGS. 1 and 2A, the single frame 18 elevates the chair portion 19 and desk top portion 22 off the floor and maintains the chair portion 19 at a pre-determined distance from the front edge 39 of the desk top portion 22. The frame 18 is formed from a series of substantially vertically oriented interconnecting legs 40, 42, 45, 46, and substantially horizontally oriented rods 41, 43, 44, 47.

The frame 18 comprises only two frame components for supporting the desk 10 on a floor surface: a substantially horizontal chair base support rod 41 connecting a substantially vertical first (left) front leg 42 of the frame and a substantially vertical chair leg 40, an opposite end of the chair leg 40 supporting the chair portion 19; and a substantially horizontal desk base support rod 47. The desk base support rod 47 connects a substantially vertical, opposite, second (right) front leg 46 of the frame and a substantially vertical, single rear leg 45 of the frame 18. This is advantageous in that it is simple, lightweight, and easy to manufacture, and facilitates stacking of desks 10. A desk need not have four conventional legs, or two matching side support rods, and this modular triangular desk 10 does not.

The second (right) front leg 46 projects upwardly from an end of the desk base support rod 47 and the single rear leg 45 projects upwardly from an opposite end of the desk base support rod 47. The rear leg 45 contacts an underside of the monitor portion 23 at its apex 27 and thus supports the rear end of the desk top portion 22. The first/left front leg 42 projects upwardly from an end of the chair base support rod 41 and the chair leg 40 projects upwardly from an opposite end of the chair base support rod 41. The seating surface 20 is bolted to an end of the chair leg 40 opposite the chair base support rod 41. The first/left and second/right desk support rods 43 and 44 are affixed to edges 35A, 29, 37 and edges 35B, 30, respectively. Ends of the first (left) desk support rod 43 join an end of the first (left) front leg 42 opposite the chair base support rod 41 and an end of the second (right) desk support rod 43 adjacent the apex 27. An opposite end of the second (right) desk support rod 43 joins an end of the second (right) front leg 46 opposite the desk base support rod 47.

Continuing with FIGS. 1 and 2A, the chair portion 19 comprises the seating surface 20, which is preferably generally circular or ovular in shape. The seating surface 20 is pivotable and rotatable in a generally horizontal plane about the central chair leg 40. The front end of the chair reversibly pivots slightly downwardly, and the rear end of the chair also reversibly pivots slightly downwardly. The chair further rotates a predetermined number of degrees clockwise and counterclockwise. Preferably, the chair rotates between about 90 degrees and 180 degrees clockwise, and between about 90 degrees and 180 degrees counterclockwise.

The chair portion optionally includes a back rest 21, which extends substantially vertically from a rear end of the seating surface 20. As shown in FIGS. 1 and 2A, the back rest 21 is curved and conforms to the curvature of the perimeter of the seating surface 20 and to a user's back. The back rest 21 is optionally removable to facilitate stacking of two or more desks 10.

In another version of the modular triangular desk 10, the chair portion 19 does not comprise a back rest 21. The first (left) front leg 42, second (right) front leg 46, and rear leg 45 of the desk are vertically oriented. Therefore, the desk base support rod 47 is located directly below the second (right) desk support rod 44. The chair leg 40 is also vertically oriented.

In yet another embodiment of the present modular triangular desk 10, the chair portion 19 comprises a back rest 21. The first (left) front leg 42, second (right) front leg 46, and rear leg 45 are vertically oriented. Therefore, the desk base support rod 47 is located directly below the second (right) desk support rod 44. The chair leg 40 is also generally vertically oriented. As such, the desk 10 is not stackable on another, identical desk 10.

Figure 3:
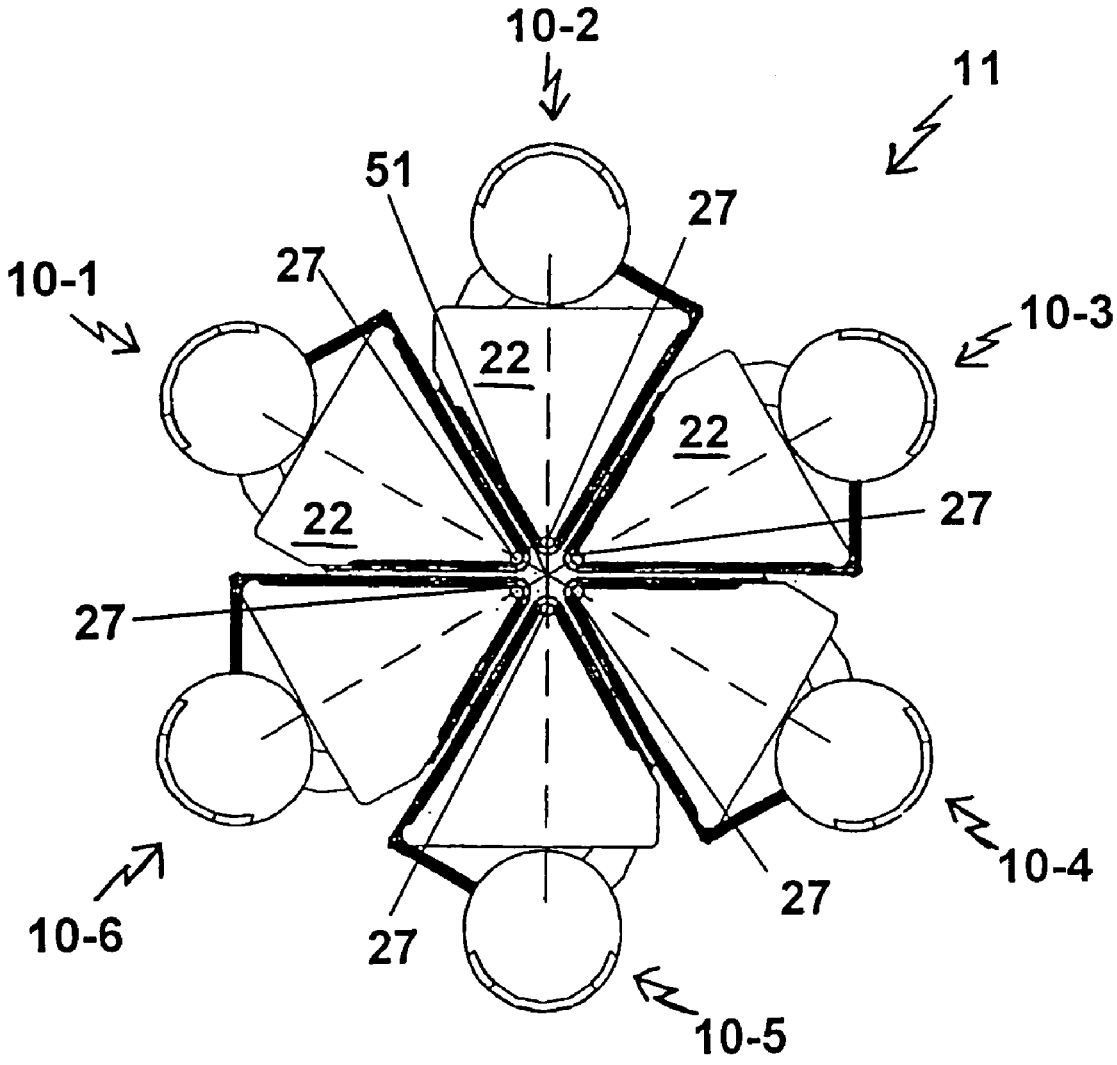
FIG. 3 is a top plan view of a circular cluster of six modular, triangular-shaped desks according to the present invention.
Figure 4:
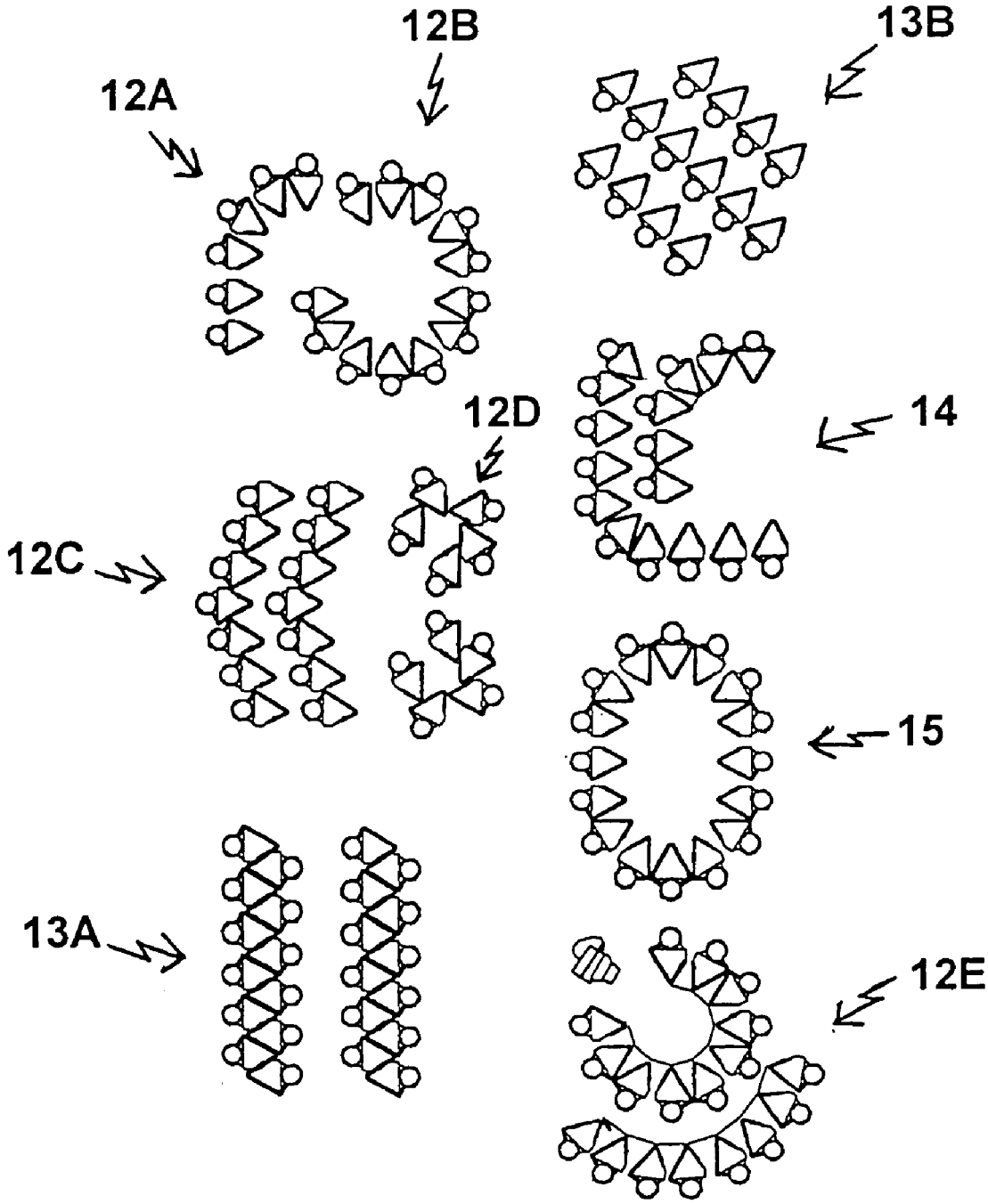
FIG. 4 is a top plan view of curved arrangements, linear arrangements, an angled arrangement, and an ovular arrangement of a number of modular, triangular-shaped desks according to the present invention.
Figure 5:
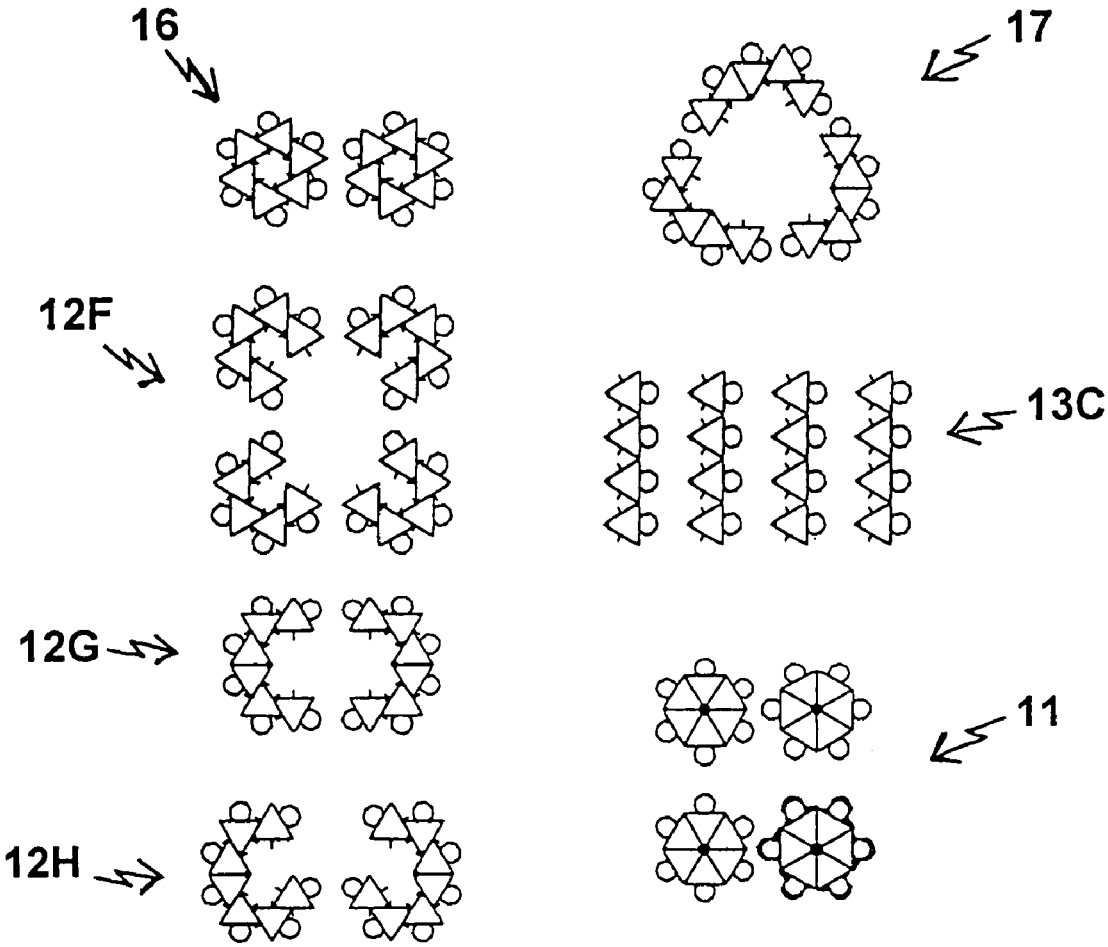
FIG. 5 is a top plan view of a circular arrangement, a triangular arrangement, curved arrangements, a linear arrangement, and circular clusters of a number of modular, triangular-shaped desks according to the present invention.

Turning now to FIGS. 3 through 5, the modular triangular-shaped desks 10 can be arranged into generally hexagonal (or "circular") clusters 11 of six desks 10-1, 10-2, 10-3, 10-4. 10-5, 10-6. The apexes 27 of the desk top portions 22 point toward a center 51 of the cluster 11. The first (left) desk support rod 43 of each desk in the cluster 11 lies substantially parallel and adjacent to the second (right) desk support rod 44 of the desk to its immediate left, while the second (right) desk support rod 44 of each desk in the cluster 11 lies substantially parallel and adjacent to the first (left) desk support rod 43 of the desk to its immediate right. For example, the first (left) desk support rod 43 of desk 10-1 lies substantially parallel and adjacent to the second (right) desk support rod 44 of desk 10-2 and the second (right) desk support rod 44 of desk 10-1 lies substantially parallel and adjacent to the first (left) desk support rod 43 of desk 10-6. If the desks 10-1, 10-2, 10-3, 10-4, 10-5, 10-6 are not stackable, the first (left) and second (right) desk support rods 43, 44 of each desk 10 abut the first (left) and second (right) desk support rods 43, 44 of the adjacent desks 10. For example, the first (left) desk support rod 43 of desk 10-1 contacts the second (right) desk support rod 44 of desk 10-2 and the second (right) desk support rod 44 of desk 10-1 touches the first (left) desk support rod 43 of desk 10-6. The desk top portion 22 may not be perfectly triangular in shape; the lower right desk corner section 63 may be absent in order to facilitate ingress to and egress from the seating portion 20. This feature makes it more comfortable for the user to enter and exit the chair portion.

As shown in FIGS. 4 and 5, the modular triangular-shaped desks 10 may be grouped in a variety of arrangements. For example, the desks 10 may be grouped into curved arrangements 12A–B that are semi-ovular in shape, in which the desk top portions 22 are on the inside of the curve and the chairs 19 are on the outside of the curve. In curved arrangement 12C, again, the desk top portions 22 are on the inside of the curve and the chairs 19 are on the outside of the curve. However, they are staggered so that they face the same direction. Curved arrangement 12D is semi-circular in shape, and each desk 10 is substantially perpendicularly oriented to the desks 10 adjacent to it: Curved arrangement 12E is also semi-circular in shape. The desk top portions 22 are on the inside of the semi-circle and the chairs 19 are on the outside of the semi-circle. With this arrangement, a larger semi-circle of desks 10 may be placed behind a smaller semi-circle of desks 10. Curved arrangements 12F–H exhibit some other possible curved arrangements. The triangular desks 10 are versatile and may easily be moved into a variety of configurations. Of course, the arrangements depicted in FIGS. 4 and 5 are only a small sampling of many possible arrangements.

The wedge shape of the desks 10 also facilitates formation of a variety of linear arrangements 13A–C. With regard to linear arrangement 13A, a first, straight row of triangular desks 10 is interspersed between a second, straight row of triangular desks 10 facing a direction that is 180 degrees opposite a direction that the first, straight row of desks 10 is facing. Spaced apart, generally parallel straight rows of triangular desks 10 facing the same direction form linear arrangements 13B–C, however, in linear arrangement 13B each row does not have the same number of triangular desks 10, while in linear arrangement 13C each row has the same number of triangular desks 10.

Other examples of desk arrangements include an angled arrangement 14, an ovular arrangement 15, a circular arrangement 16, and a triangular arrangement 17. According to the angled arrangement 14, the triangular desks 10 are organized into the shape of an approximately ninety degree angle. The ovular arrangement 15 is generally in the shape of an oval, in which the desk top portions 22 are on the inside of the oval and the chairs 19 are on the outside of the oval. According to the circular arrangement 16, six triangular desks 10 are arranged in a pinwheel-like fashion. In the last, triangular arrangement 17, several triangular desks 10 form an equilateral triangle.

The triangular shape of the desk 10 is advantageous over the traditional rectangular shape of conventional student desks. Certain arrangements of a number of triangular desks 10, such as a circular arrangement 16, require less space than identical arrangements of the same number of traditional rectangular student desks. Certain arrangements, such as the cluster 11, are not possible with traditional rectangular student desks. Thus, the modular triangular desk 10 of the present invention offers school administrators, interior decorators, teachers, and students more freedom in classroom design and organization. It enhances the traditionally box-shaped, stifling classroom environment, promotes creativity, and encourages students to think outside of the box.

Naturally, the present modular desk 10 may be utilized outside of the classroom, for example, in the home or office. Several removable attachments enhance the versatility of the triangular modular desk 10 and make it suitable for different applications, such as seat covers, and back rests. The desk top portion 22, the frame 18, and the chair portion 19 are preferably made of plastic, wood, and/or aluminum so that they are sturdy, resilient, and easy to manufacture.

Figure 6:
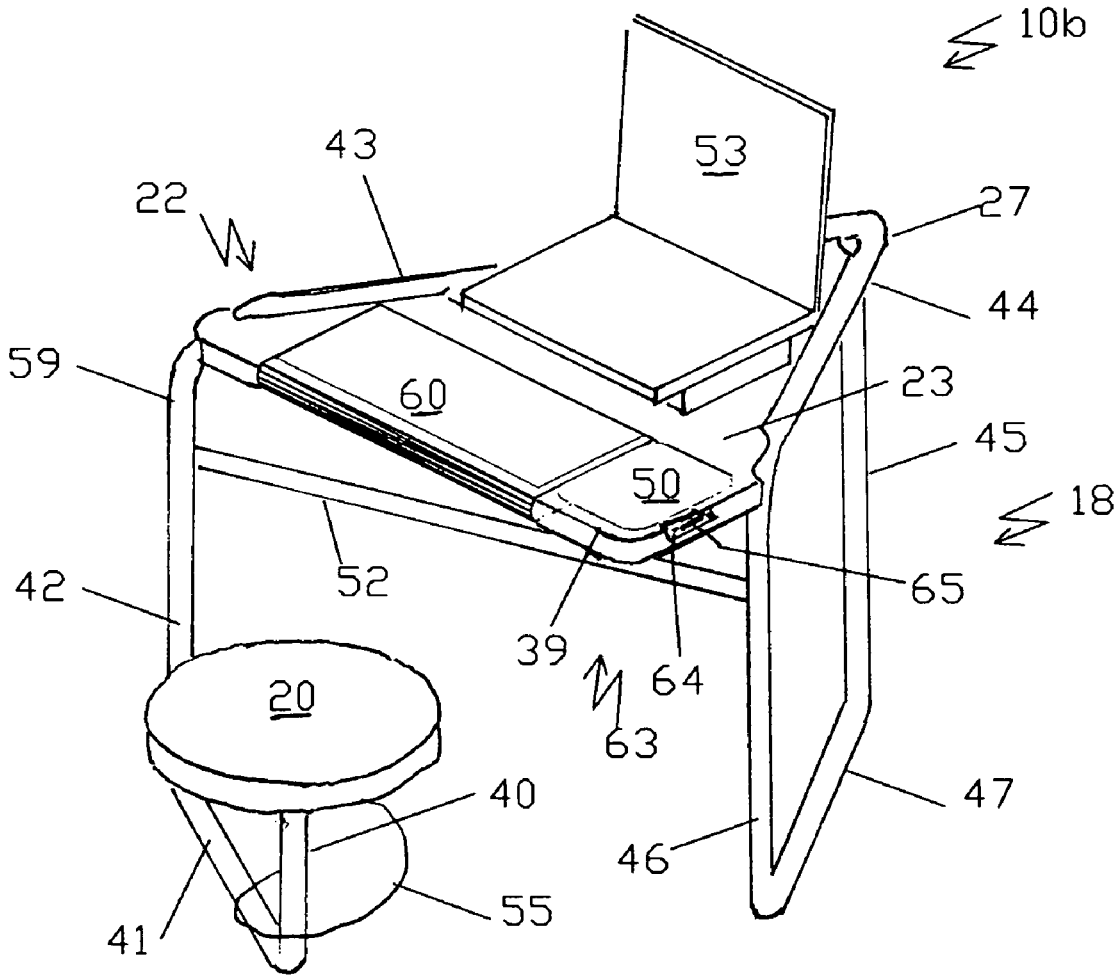
FIG. 6 is a front perspective view of a modular, triangular-shaped desk according to the present invention.
Figure 7:
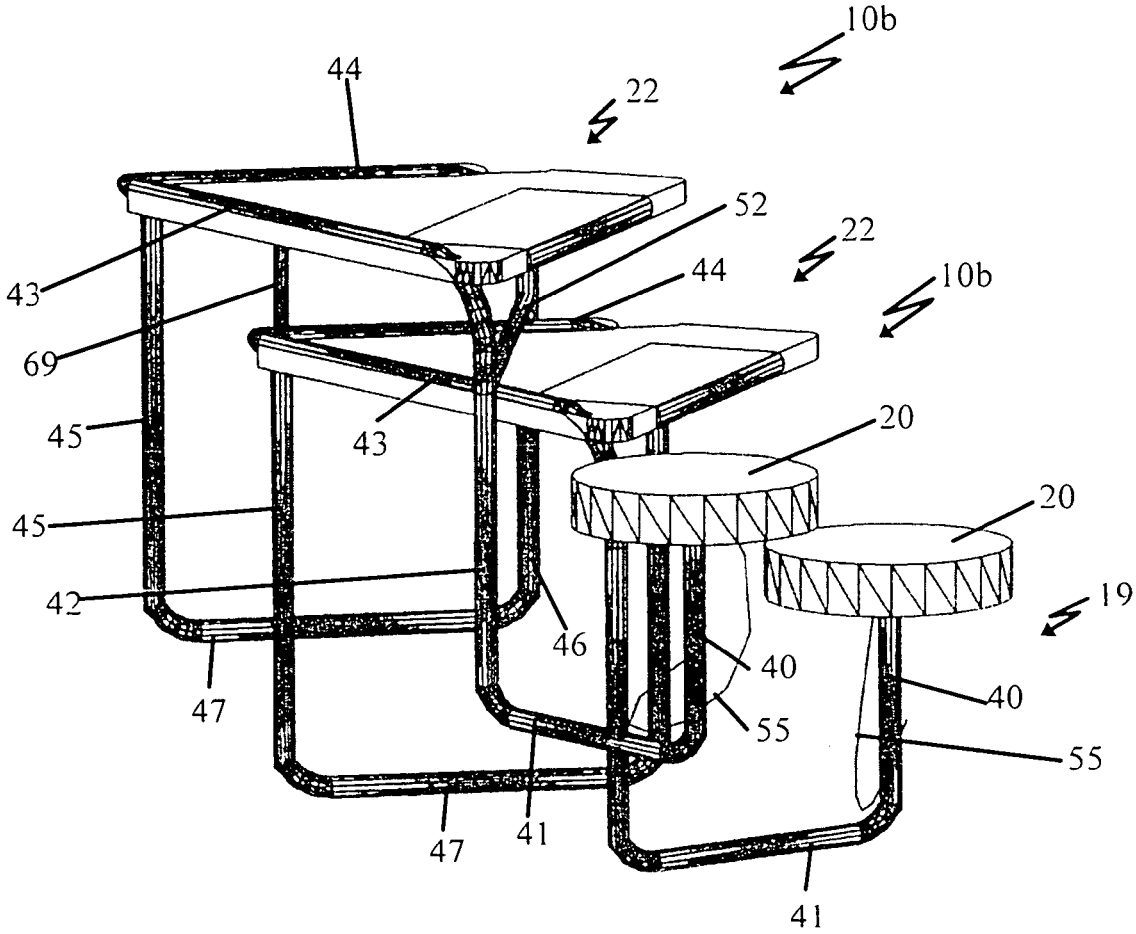
FIG. 7 is a side perspective view of two, stacked modular, triangular-shaped desks according to the present invention.
Figure 8:
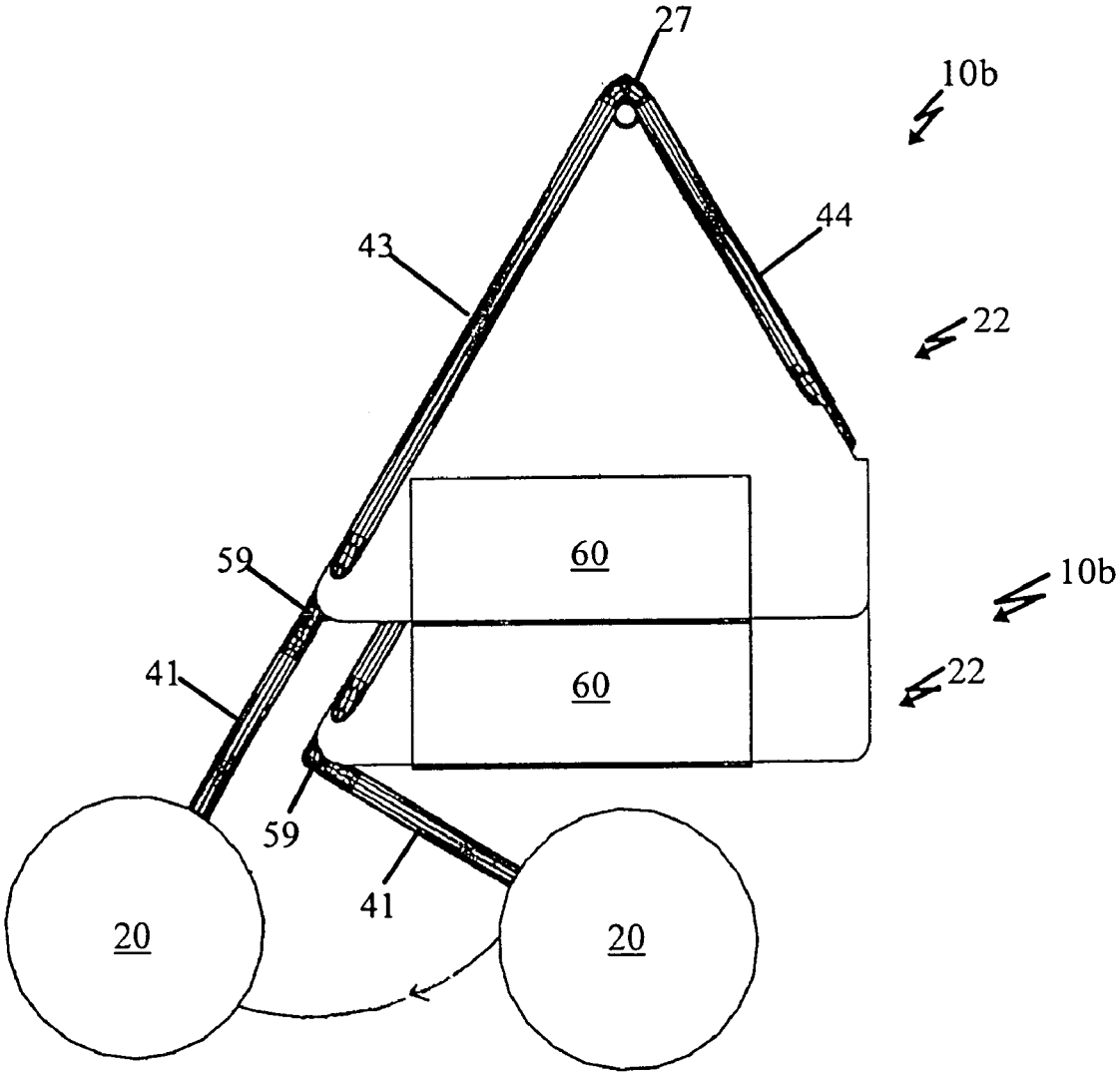
FIG. 8 is a top plan view of two, stacked modular, triangular-shaped desks according to the present invention.

Turning to FIGS. 6, 7, and 8, a preferred embodiment of the present triangular modular desk 10*b* with a backless chair portion is also stackable. As shown in FIG. 6, the desk 10*b* includes a frame 18 that includes a series of substantially vertically oriented interconnecting legs 40, 42, 45, 46, and substantially horizontally oriented rods 41, 43, 44, 47. The chair base support rod 41 and the desk base support rod 47 rest on the floor and provide a base for supporting the modular triangular desk 10. The second (right) front leg 46 projects upwardly from an end of the desk base support rod 47 and the rear leg 45 projects upwardly from an opposite end of the desk base support rod 47. The rear leg 45 contacts an underside of the monitor portion 23 at its apex 27 and thus supports the rear end of the desk top portion 22. The first (left) front leg 42 projects upwardly from an end of the chair base support rod 41 and the chair leg 40 projects upwardly from an opposite end of the chair base support rod 41. The seating surface 20, which resembles a stool in this embodiment, is bolted to an end of the chair leg 40 opposite the chair base support rod 41.

Continuing with the frame, the first (left) and second (right) desk support rods 43, 44 are affixed to edges 35A, 29, 37 and edges 35B, 30, respectively. Ends of the first/left desk support rod 43 join an end of the first/left front leg 42 opposite the chair base support rod 41 and an end of the second (right) desk support rod 43 adjacent the apex 27. An opposite end of the second/right desk support rod 43 joins an end of the second/right front leg 46 opposite the desk base support rod 47. As seen in FIG. 6, a generally horizontal tie rod 52 connects the second/right front leg 46 to the first/left front leg 42 at the front of the desk. The tie rod 52 is advantageous in that it helps structural integrity. The desk top is not perfectly triangular in shape and extends out along the mouse pad area in the right desk corner section 63 to facilitate egress from the chair. A rotatable keyboard rest 60 as described below in paragraphs [0059–62] and mouse pad 50 area are also provided.

The left and right desk support rods 43, 44 are optionally two segments of a single tubular rod bent approximately in the middle at the apex 27 of the triangular desk top to form an angle of between about 45 and about 75 degrees, most preferably about 60 degrees. The end of the left desk support rod 43 preferably extends through a hole in a first/left corner section 67 of the desk, as seen in FIG. 6.

Prior to stacking two or more desks as shown in FIGS. 7 and 8, the seating surface 20 is rotated out to the side as shown in FIG. 8, and then the desk 10*b* is stacked on top of another one of the desks 10*b* once any notebook computer 53, books, pens, etc. have been removed from the desk tops. Several, identical triangular desks 10*b* may be stacked on top of one another for space efficient storage. Since the modular triangular desks 10, 10*b* are preferably made of a lightweight material, several modular desks 10, 10*b* may be stacked in this manner and carried from one classroom to another, for example.

The seating surface 20 is turned out approximately ninety degrees prior to stacking of the desks by means of a leg joint 59 in the first (left) front leg 42 of the frame 18 (see FIG. 8). The leg joint 59 fits over the top of the generally vertical first (left) front leg 42 and connects to a downwardly curved end of the generally horizontal first (left) desk support rod 43. The first (left) desk support rod 43 connects at its opposite end to the second (right) desk support rod 44 at one apex 27 of the triangular desk top. Since the first (left) front leg 42 is rotatable in the leg joint 59, the standing user merely pushes the seating surface 20 over to the left in order to move the seating surface 20 away from the front of the desk 10*b* so the desk can be stacked. This same chair leg mechanism can be used for the seating surface with a back rest 21 described hereinabove.

Also, the user can push the seating surface slightly to the left or right to adjust the nearness of the seating surface to the desk. This is helpful, for example, where the user wants to stretch his or her legs, in which case the user pushes the seating surface away from the desk top, or move closer to a book, for example, on the desk surface, in which case the user pushes the seating surface to the right and closer to the desk top.

The desk top portion optionally includes a hole over the top of the rear leg 45, as seen in FIGS. 2A and 6. A lower portion of a leg pin 69 is optionally insertable into this hole. The generally vertically oriented leg pin 69 extends up in a generally vertical direction from the rear leg 45. When the second, upper desk 10*b* is horizontally stacked on the first, lower desk 10*b*, the bottom of the desk top of the second desk is supported on the top of the leg pin 69, as shown in FIG. 7. Also, the generally horizontal tie rod 52 of the second desk is supported across the first/left and second/right desk support rods 43, 44 of the first desk, so the desk base support rod 47 and the chair base support rod 41 of the second desk are suspended above the floor surface. The second, upper desk is horizontally stacked on and supported by the first, lower desk; the two stacked desks are not directly on top of one another.

Figure 9:
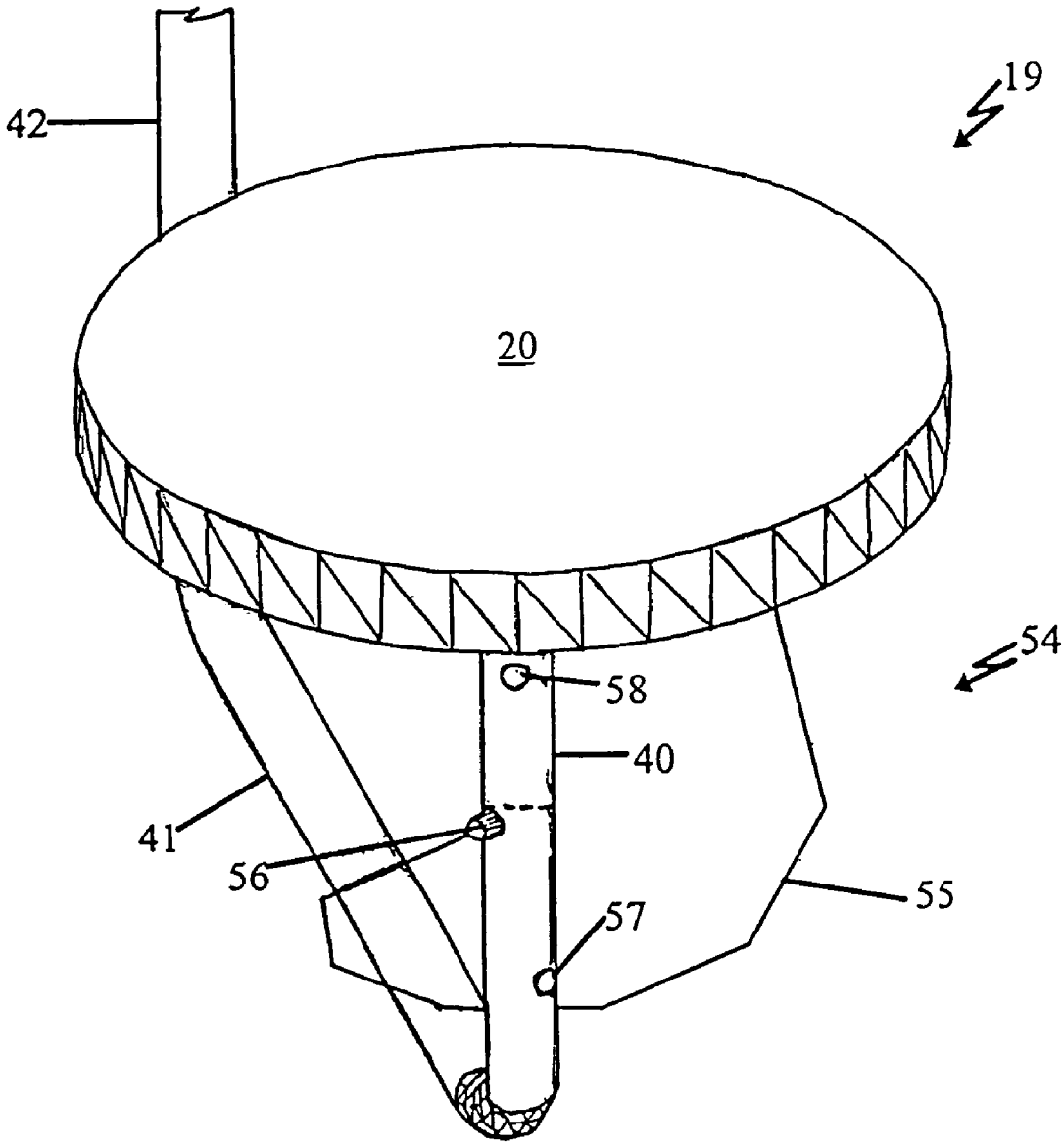
FIG. 9 is a perspective view of a seat portion of a modular, triangular-shaped desk according to the present invention, showing a mechanism for adjusting the seat height.

Referring to FIG. 9, a mechanism 54 for adjusting the height of the seating support 20 comprises a cord 55 attached at one end to the bottom of the seating surface 20 and to a plug 56 at its opposite end. The plug 56, which is made of a sturdy material, is insertable into one of several holes 57 in the chair leg 40. The chair leg holes 57 are positioned at varying heights along the chair leg 40. An inner chair leg segment 58, which can be seen through the uppermost hole 57 in FIG. 9, is connected at one (upper) end to the center of the seating surface 20. The inner chair leg segment slidably extends closely into the open top of the chair leg 40. The opposite, lower end (see dashed line) of the inner chair leg segment 58 inside the chair leg rests on the plug 56. Thus, if the plug is in the lowermost hole 57, the seating surface will be at a lower level than if the plug is in the upper most chair leg hole. The cord 55, which should not be overly long, assures that the plug 56 will not be lost and provides a rapid way to locate or pull the plug.

To use the seat height adjustment mechanism 54, a user simply lifts the seating surface 20 up slightly, which pulls the inner chair leg segment 58 up, inserts the plug 56 in an appropriate chair leg hole 57, and lets the seating surface 20 drop back down to that position. The next seat user can lift the seating surface slightly, pull out the plug 56, and insert the plug in a different one of the chair leg holes 57, depending on the desired height of the seat. Normally, a student who is short in height will use an upper one of the chair leg holes 57, and a taller student user will use a lower one of the chair leg holes. The same chair height adjustment mechanism 54 is suitable for raising and lowering the seating surface with a back rest 21 described hereinabove.

Figure 10:
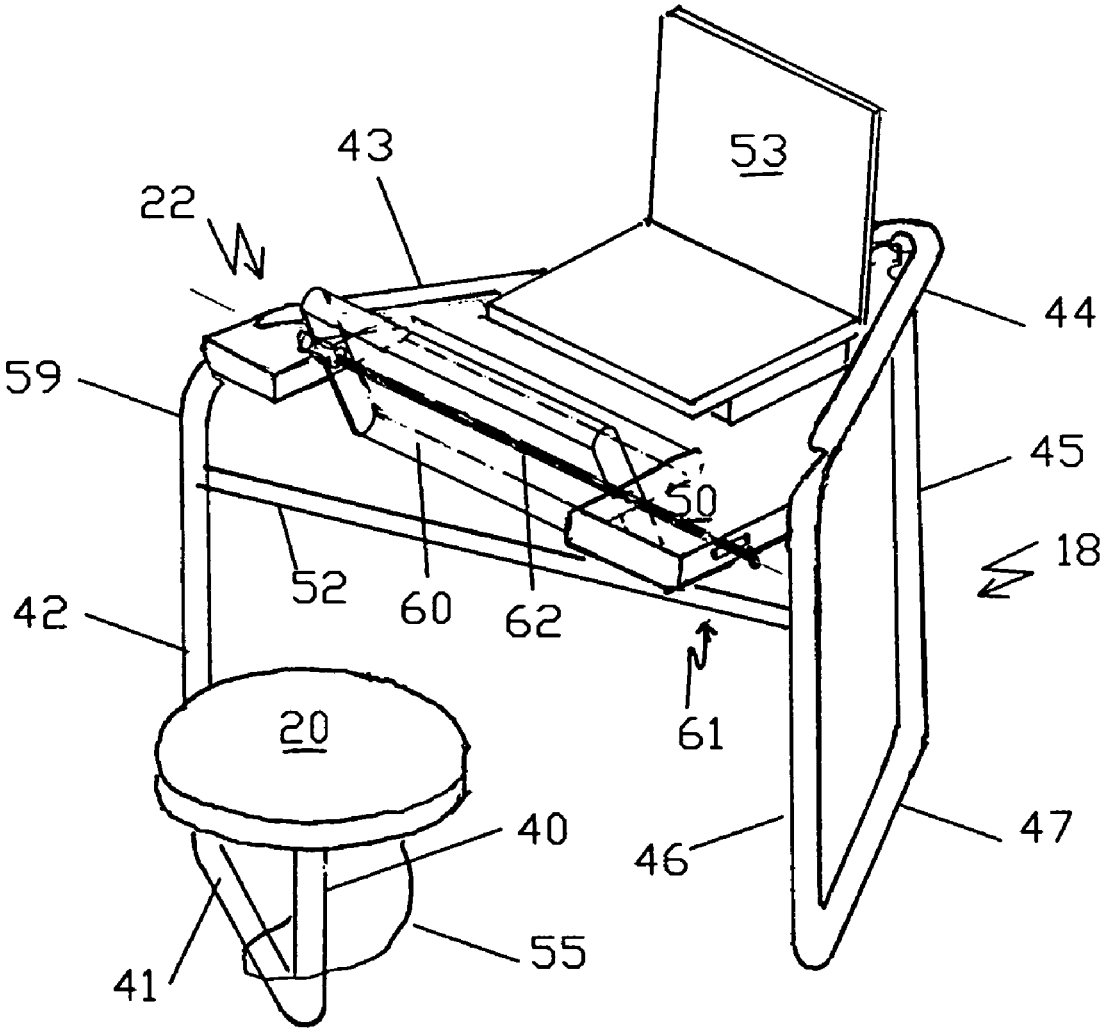
FIG. 10 is a front perspective view of a modular, triangular-shaped desk according to the present invention, shown with keyboard in a half turned position.
Figure 11:
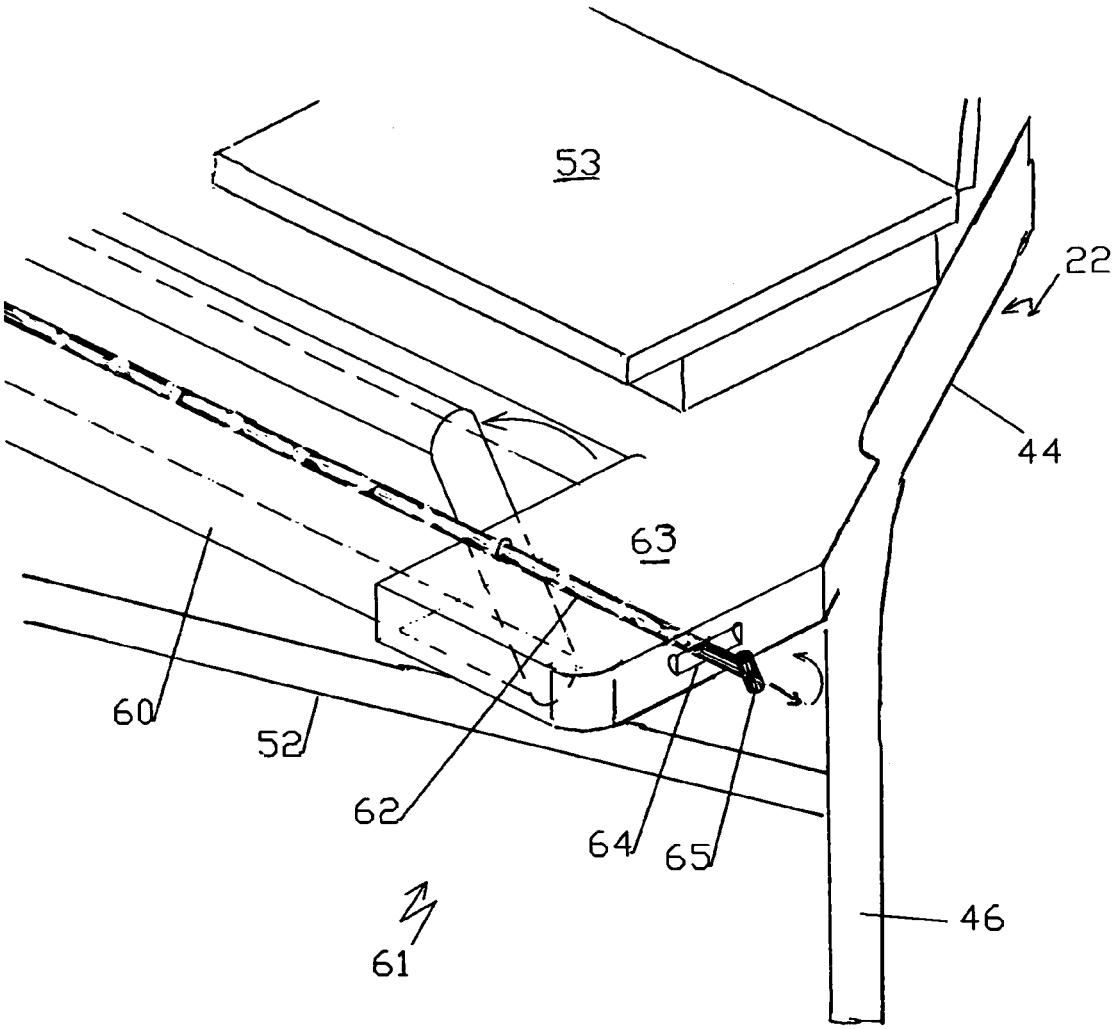
FIG. 11 is a schematic perspective view of a front portion of a modular, triangular-shaped desk according to the present invention, showing a mechanism for rotating the keyboard rest.
Figure 12:
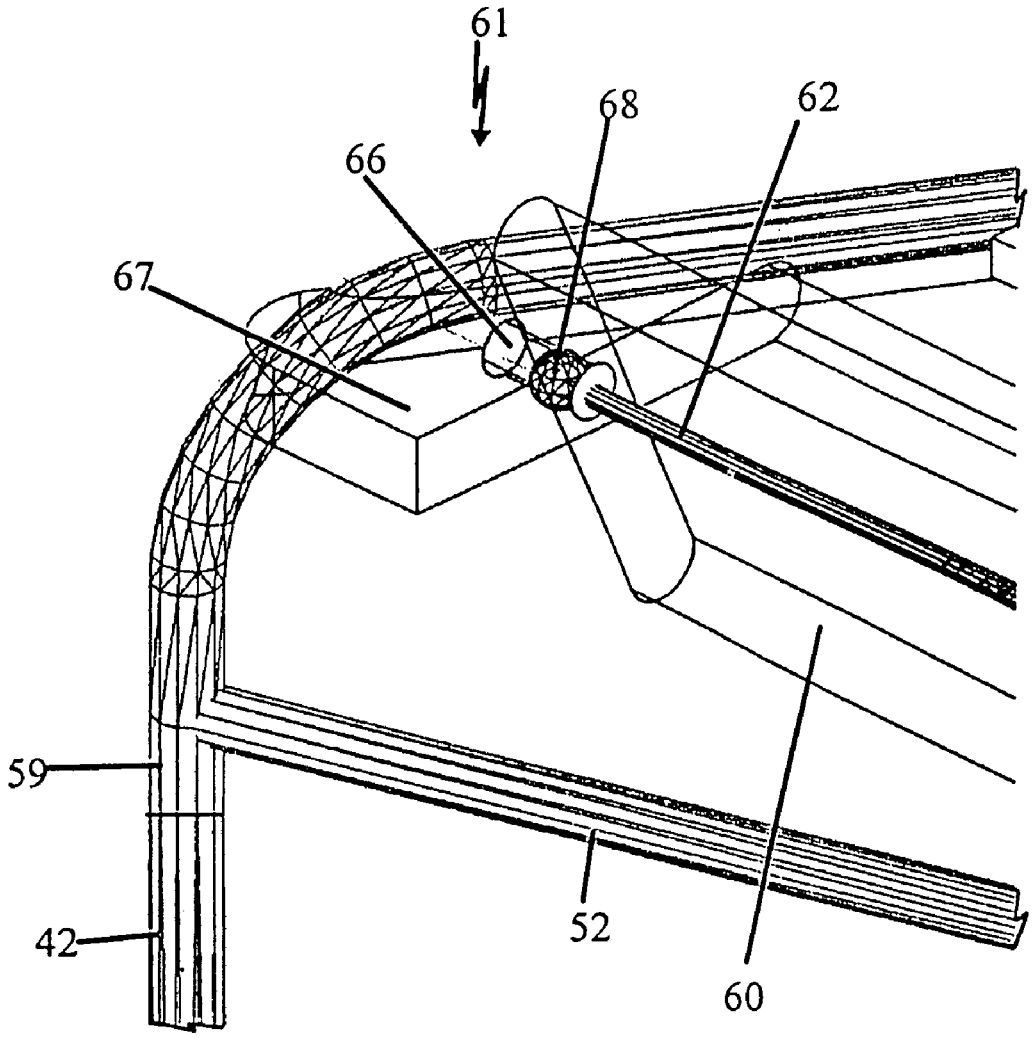
FIG. 12 is a schematic perspective view of a front portion of a modular, triangular-shaped desk according to the present invention, showing an end portion of a mechanism for rotating the keyboard.

Turning to FIGS. 10 through 12, the modular triangular desk 10*b* preferably includes a mechanism 61 for rotating the keyboard arm/rest 60. A keyboard rest rod 62 extends through the longitudinal center of the generally rectangular-shaped rotatable keyboard arm/rest 60. As shown in FIG. 11, an end portion of the keyboard rest rod 62 continues through a space in the second/right corner section 63 of the desk top. The end of the keyboard rest rod 62 extends out through a slot 64 along the outer edge of the desk second corner section 63. A rod handle 65 at the end of the rod 62 corresponds in size to the keyboard rest desk slot 64. The rod handle 65 and rod 62 preferably form a T-shape. The keyboard rest rod 62 is movable in the desk second corner section 63, but is affixed in the separate, rotatable keyboard arm/rest 60, so rotating the handle 65 in one direction rotates the keyboard arm/rest in the same direction.

Continuing with FIG. 12, an opposite end portion of the keyboard rest rod 62 extends into a rod knob space 66 in the opposite, first, left corner section 67 of the desk top. A rotatable knob 68 at the end of the keyboard rest rod 62 rotates in the rod end space 66 as the rod handle 65 is rotated. The rotatable keyboard arm/rest 60 is slightly smaller in length than the desk top space it fits into, providing an inch or so of play on each end of the keyboard rest. This allows the rod handle 65 to be moved in and out several inches, in addition to it being rotatable. The rod knob space 66 is several inches in length to accommodate this movement.

To use the keyboard rest rotation mechanism 61, the user pulls the rod handle 65 slightly out of the slot 64 and turns the handle in the desired direction. This rotates the keyboard arm/rest 60 in the same direction. Pushing the rod handle 65 into the like-sized slot locks the rotatable keyboard arm/rest 60 in place until the user desires to move it again. The flee right corner section 63 of the desk allows easy access to the rod handle and slot.

The student's keyboard and/or docking station are removably attached to the keyboard rest 60 by corresponding hook and loop strips on the bottom of the keyboard and the top face of the keyboard rest, or by any other suitable means. When the student no longer needs to utilize the computer, the keyboard rest 60 rotates 180 degrees and stores out of the way. When the keyboard rest 60 is turned upside down, gravity causes most crumbs and dirt particles, such as dust, that have accumulated between the keys of the keyboard to dislodge. Rotation of the keyboard rest 60 is also advantageous in that it permits the student to easily access the opposite, vacant surface of the desk rest for writing, reading, etc.

In one embodiment, the frame 18 is made of one or two pieces of tubular pipe, which is/are bent to form the frame 18. The chair base support rod 41 and chair leg 40, and optionally the first/left desk support rod 43, may be made of a single bent piece of tubular pipe. Similarly, the desk base support rod 47, rear leg 45, and right front leg 46, and optionally the right desk support rod 44, may be made of a single length of tubular pipe that is bent at approximately right angles. In any embodiment herein, a conventional hook can be fastened to any frame component, such as the right or left leg 42, 46, for hanging a backpack, handbag, etc.

From the foregoing it can be realized that the described device of the present invention may be easily and conveniently utilized as a modular triangular student desk for holding a desktop or notebook computer, docking station, keyboard, mouse pad, and/or a mouse. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A stackable, modular triangular desk, comprising:

(a) a generally triangular-shaped, substantially planar desk top portion;

(b) a frame attached to the desk top portion supporting the desk top portion in an elevated position; and (c) a chair portion supported by the same frame and spaced apart from a front edge of the desk top portion;

wherein the generally triangular-shaped desk top portion comprises two side edges, each of which is connected to a desk support rod of the frame, the desk support rods each being connected to at least one leg of the frame, an end of a single, front one of the legs of the frame being connected to one end of a chair base support rod of the frame, an opposite end of the chair base support rod being connected to an end of a single chair leg, an opposite end of the chair leg being connected to a seating surface of the chair portion.

2. The modular triangular desk according to claim 1, wherein the frame comprises only two frame components for supporting the desk on a floor surface, the frame components being: the substantially horizontal chair base support rod connecting the substantially vertical front leg of the frame and the substantially vertical chair leg, the opposite end of the chair leg supporting the chair portion; and a substantially horizontal desk base support rod connecting a substantially vertical, opposite front leg of the frame and a substantially vertical, single rear leg of the frame.

3. The modular triangular desk according to claim 2, wherein the desk and five identical desks are arrangeable into a cluster, wherein the cluster is generally hexagonal in shape, the first desk support rod of each desk is generally parallel to a second desk support rod of a first adjacent desk, and the second desk support rod of each desk is generally parallel to a first desk support rod of a second adjacent desk.

4. A stackable, modular triangular desk, comprising: (i) a generally triangular-shaped, substantially planar desk top portion; (ii) a frame attached to the desk top portion supporting the desk top portion in an elevated position; and (iii) a chair portion supported by the same frame and spaced apart from a front edge of the desk top portion; wherein the frame comprises:

(a) the following generally tubular, generally vertically oriented legs: a first front leg; a rear leg spaced apart from the first front leg; and a second front leg spaced apart from the first front leg and from the rear leg;

(b) the following generally tubular, generally horizontally oriented rods: a first desk support rod extending between an upper end of the first front leg and an upper end of the rear leg; a second desk support rod extending between the upper end of the rear leg and an upper end of the second front leg; and a desk base support rod extending between a lower end of the rear leg and a lower end of the second front leg;

wherein the first and second desk support rods are attached to the desk top portion, and the rear leg contacts an underside of the desk top portion at an apex of the generally triangular-shaped desk top portion; and wherein the generally triangular-shaped desk top portion comprises two side edges each of which is connected to one of the desk support rods the desk support rods each being connected to at least one of the legs of the frame, an end of a front one of the frame legs being connected to one end of a chair base support rod of the frame an opposite end of the chair base support rod being connected to an end of a chair leg, an opposite end of the chair leg being connected to a seating surface of the chair portion.

5. The modular triangular desk according to claim 4, wherein the desk top portion generally has the shape of an equilateral triangle.

6. The modular triangular desk according to claim 4, wherein the chair portion comprises a generally horizontally oriented seating surface.

7. The modular triangular desk according to claim 6, wherein the frame further comprises:

(a) a generally vertically oriented chair leg connected to the seating surface; and (b) a generally horizontally oriented chair base support rod extending between a lower end of the first front leg and a lower end of the chair leg;

wherein the frame does not comprise any component on the front edge of the desk top portion.

8. The modular triangular desk according to claim 7, wherein the desk is stackable on another modular triangular desk.

9. The modular triangular desk according to claim 8, wherein the desk top portion of a first, lower one of the stackable desks comprises a hole over the rear leg, into which a lower portion of a leg pin is insertable; wherein a desk top portion of a second, upper one of the stackable desks is supported on an upper end of the vertically extending leg pin.

10. The modular triangular desk according to claim 9, wherein the second desk comprises a generally horizontal tie rod, which is supported across the first and second desk support rods of the first desk, so the desk base support rod and the chair base support rod of the second desk are suspended above a floor surface.

11. The modular triangular desk according to claim 7, wherein the desk is removably attachable to a first, identical modular triangular desk on a first side, and a second, identical modular triangular desk on an opposite, second side.

12. The modular triangular desk according to claim 7, further comprising a mechanism for adjusting the height of the seating support comprises a length of cord attached at one end to the seating surface and to a plug at its opposite end; wherein the plug is insertable in one of a plurality of holes in the chair leg.

13. The modular triangular desk according to claim 12, further comprising an inner chair leg segment connected at one, upper end to the seating surface, the inner chair leg segment slidably extending closely into the chair leg; wherein an opposite, lower end of the inner chair leg segment is restable on the plug.

14. The modular triangular desk according to claim 7, further comprising a separate, rotatable, generally planar keyboard rest, and a mechanism for rotating the keyboard rest; the keyboard rest rotation mechanism comprising a keyboard rest rod attached to the longitudinal center of the keyboard rest.

15. The modular triangular desk according to claim 14, wherein an end portion of the keyboard rest rod movably extends through a second corner section of the desk top portion and out through a slot in the desk second corner section, the keyboard rest rod comprising a rod handle at its end, the rod handle generally corresponding in size to the keyboard rest desk slot.

16. The modular triangular desk according to claim 15, wherein an opposite end portion of the keyboard rest rod movably extends into a rod knob space in an opposite, first corner of the desk top portion, the keyboard rest rod comprising a rotatable knob at this opposite end of the rod, the knob being rotatable in the rod end space as the rod handle is rotated.

17. The modular triangular desk according to claim 6, wherein the seating surface is pivotable and rotatable about the chair leg, and the chair portion comprises a removable back rest extending generally vertically from the seating surface.

18. The modular triangular desk according to claim 6, further comprising a leg joint in the first front leg of the frame; wherein the seating surface and chair leg are movable in an angle of up to about ninety degrees from a center front of the desk to a first side of the desk.

19. The modular triangular desk according to claim 18, wherein the leg joint fits over the top of the generally vertical, first front leg and connects to a downwardly curved end of the generally horizontal first desk support rod.

20. The modular triangular desk according to claim 4, wherein the desk top portion comprises:

(a) a monitor portion for holding the computer monitor;

(b) a work portion adjacent to and in front of the monitor portion; and (c) a keyboard arm adjacent to the work portion for holding the keyboard;

wherein the monitor portion is generally triangular in shape and the work portion and the keyboard arm are generally trapezoidal in shape.

21. The modular triangular desk according to claim 20, wherein the keyboard arm is rotatable and securable to an underside of the work portion.

22. The modular triangular desk according to claim 4, wherein the first and second desk support rods are two segments of a single tubular rod bent approximately in the middle to form an angle of between about 30 and about 60 degrees.

* * * * *